US010538898B2

(12) United States Patent
Rinas

(10) Patent No.: US 10,538,898 B2
(45) Date of Patent: Jan. 21, 2020

(54) HIGH PRESSURE WATER JET ADD-ON TO HYDROVAC BOOM HOSE

(71) Applicant: Ryan Leslie Rinas, Wainwright (CA)

(72) Inventor: Ryan Leslie Rinas, Wainwright (CA)

( * ) Notice: Subject to any disclaimer, the term of this patent is extended or adjusted under 35 U.S.C. 154(b) by 0 days.

(21) Appl. No.: 16/126,234

(22) Filed: Sep. 10, 2018

(65) Prior Publication Data

US 2019/0010678 A1 Jan. 10, 2019

Related U.S. Application Data

(63) Continuation-in-part of application No. 15/091,353, filed on Apr. 5, 2016, now abandoned.

(51) Int. Cl.

| | |
|---|---|
| ***E02F 3/88*** | (2006.01) |
| ***E02F 5/20*** | (2006.01) |
| ***E02F 3/92*** | (2006.01) |
| ***E02F 3/90*** | (2006.01) |
| ***E21B 7/18*** | (2006.01) |

(52) U.S. Cl.

CPC ..... *E02F 5/20* (2013.01); *E02F 3/907* (2013.01); *E02F 3/9206* (2013.01); *E21B 7/18* (2013.01)

(58) Field of Classification Search

CPC ..... A01B 1/022; E02F 3/8816; E02F 3/8891; E02F 3/88; E02F 3/907; E02F 3/925; E02F 5/003; E02F 5/925; E02F 5/266; E02F 5/20; E02F 3/9206; E21B 7/18; F02B 3/06

USPC ..... 37/307–309, 317, 323; 175/66; 294/51; 406/88

See application file for complete search history.

(56) References Cited

U.S. PATENT DOCUMENTS

| | | | | |
|---|---|---|---|---|
| 5,033,545 | A * | 7/1991 | Sudol | B08B 9/035 134/167 C |
| 6,470,605 | B1 * | 10/2002 | Gilman | E02F 3/8816 37/323 |
| 7,484,322 | B2 * | 2/2009 | Maybury, Jr. | E02F 3/8816 37/323 |
| 7,644,523 | B2 * | 1/2010 | Buckner | E02F 3/8816 37/304 |
| 8,858,124 | B2 * | 10/2014 | Lamonte | E02F 3/8825 175/67 |
| 9,512,591 | B2 * | 12/2016 | Spreitzer | E02D 5/46 |
| 2013/0313843 | A1 * | 11/2013 | Hernandez | G01V 3/088 294/51 |

* cited by examiner

*Primary Examiner* — Robert E Pezzuto
(74) *Attorney, Agent, or Firm* — Mark Terry

(57) ABSTRACT

A device for coupling to a working end of a hydrovac boom hose includes a tubular suction tube for removably coupling to the working end of the hydrovac boom hose such that an opening of the working end remains unobstructed. A plurality of high pressure turbo nozzles configured for emitting high pressure water are located around a circumference of the tubular suction tube such that the turbo nozzles surround the working end of the hydrovac boom hose to dislodge earthly materials under the device. An outer housing to enclose and protect the tubular suction tube, turbo nozzles, and onboard locating device, and to provide an air duct for ambient air to pass down threw. A plurality of air vents in the outer housing that provide flow of ambient air to an area being excavated. The conduit coupled with the outer housing, for allowing ingress of water to the plurality of high pressure turbo nozzles.

14 Claims, 5 Drawing Sheets

HIGH PRESSURE WATER JET ADD-ON TO HYDROVAC BOOM HOSE

CROSS-REFERENCE TO RELATED APPLICATIONS

This application is a continuation-in-part of U.S. Non-Provisional patent application Ser. No. 15/091,353 entitled "High Pressure Water Jet Add-On to Hydrovac Boom Hose," filed Apr. 5, 2016, the subject matter all of which is incorporated herein by reference.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of excavating, and more specifically to the field of tools used for excavating holes.

BACKGROUND

Large vertical columns or vertical structures are used to build many types of buildings or structures. Such buildings or structures may include fences, bridges, arches, aqueducts, roadways, buildings etc. In order to create an adequate foundation for these vertical columns, vertical holes are required to be dug into the ground in order to receive a lower end of these vertical columns or structures.

Pilot holes are required to dig vertical holes. In the past, pilot holes have been dug utilizing shovels, post hole shovels and other types of tools that use mechanical force to shovel or remove dirt and other earthly material from the ground in order to form a hole. However, using shovels and other related tools can cause problems. For example, buried assets such as utility cables and conduits may be damaged by a shovel or other tool when digging a hole.

More recently, hydrovacs have been used to remove dirt in order to form holes. However, hydrovacs use a two-man system. One man runs the boom and the other runs the wand. This means that there are two men within the touch potential zone if the wand or the dig tube came into contact with an underground power source.

However, may not have enough suction power in order to remove some items from the ground. In order to decrease the size of the items, water has been used in order to facilitate the removal process by using water to the erode or decrease the size of the earthly material so that the suction power of a vacuum can be used to remove earthly material.

However, one problem of using water with vacuum power is that it may be difficult to combine water erosion power with the vacuum suction power. Another problem with combining water power with vacuum suction power is that the size of the hole may be too small to incorporate both a vacuum and sufficient water erosion power. Another problem associated with existing systems for combining water and suction power is that the existing uses of combined water and suction power do not adequately confine the water and suction power to a defined area.

As a result, there exists a need for improvements over the prior art and more particularly for a more efficient way of digging or excavating pilot holes.

SUMMARY

A system and method for excavating holes is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system for excavating holes is disclosed. The system comprises a device for coupling to a working end of a hydrovac boom hose. The device includes a cylindrical suction tube configured for removably coupling to the working end of the hydrovac boom hose, such that an opening of the working end remains unobstructed. A plurality of high pressure rotating turbo nozzles are located around the outside circumference of the cylindrical suction tube, such that the high pressure rotating turbo nozzles surround the working end of the device. The high pressure rotating turbo nozzles are configured for emitting high pressure water that dislodge earthly material. A plurality of air vents are presented on the outer housing. The air vents allow the flow of ambient air to the area being excavated by the device. A conduit is coupled with the outer housing. The conduit is for allowing ingress of water to the plurality of high pressure rotating turbo nozzles.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
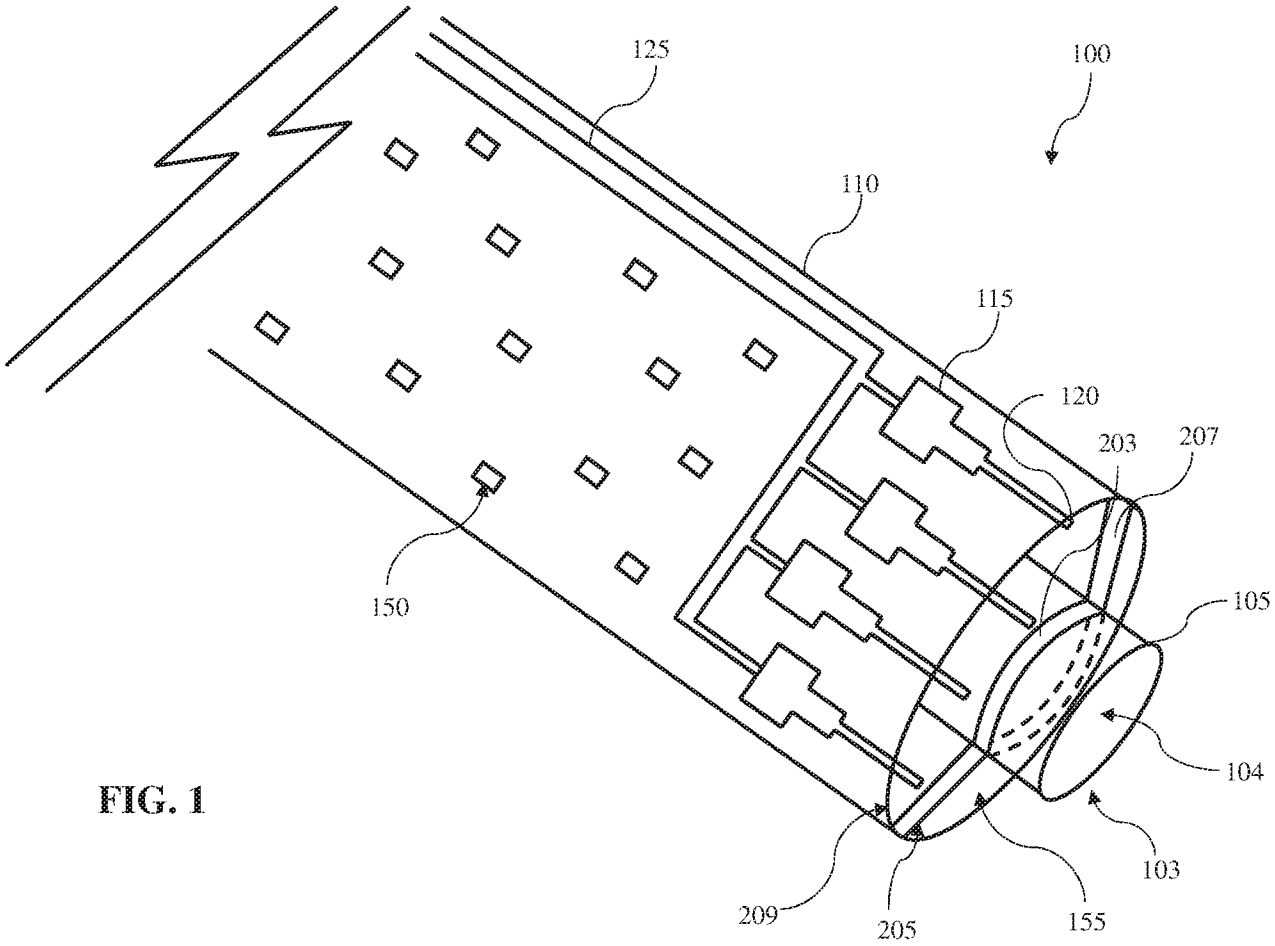
FIG. 1 is a device for coupling to a working end of a boom hose, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a device for coupling to a working end of a hydrovac boom hose. The system provides a safer, and more efficient way to non-destructively dig into soft soils to unearth and expose underground pipelines, fiber-optics and utilities, for the purpose of digging holes and removal of earthly materials. The system provides a device that combines the use of water jet power and vacuuming power in one device to reduce the space necessary to accommodate an excavating device. The system may also include an outer sleeve that surrounds the rotating turbo nozzles and boom hose, that is configured to confine fluid exiting the rotating turbo nozzles and suction force of the hydrovac boom hose to a defined area. The system also improves over the prior art by allowing the hole to be excavated without having to expose the operators to the dangers of the touch potential zone of the hydrovac boom which could possibly lead to electrical shock or electrocution, and flying debris. The system also improves over the prior art by reducing the amount of energy required to excavate a hole.

Figure 2:
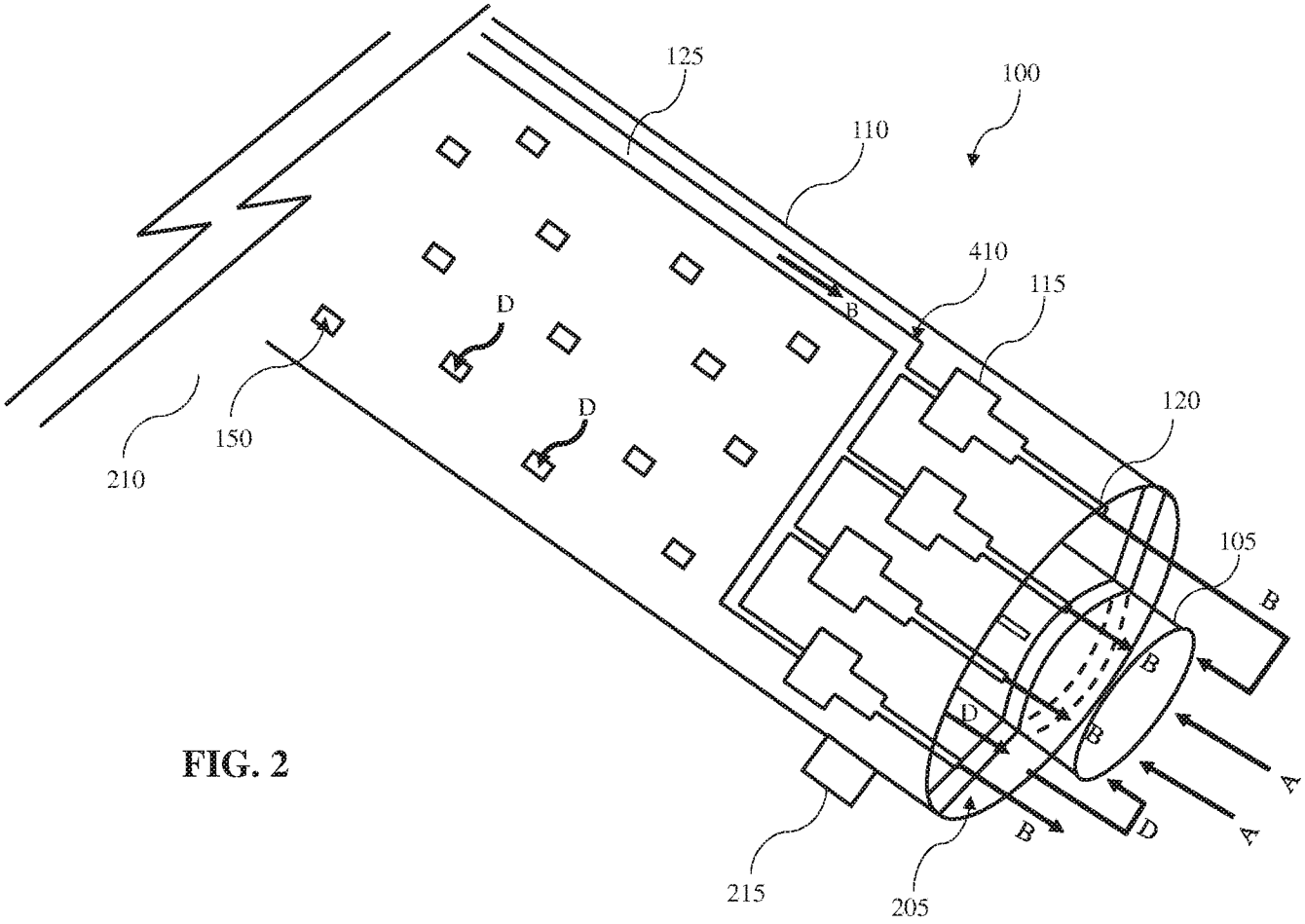
FIG. 2 is a device for coupling to a working end of a boom hose and further illustrating the flow of fluid, air and material, according to an example embodiment.
Figure 4:
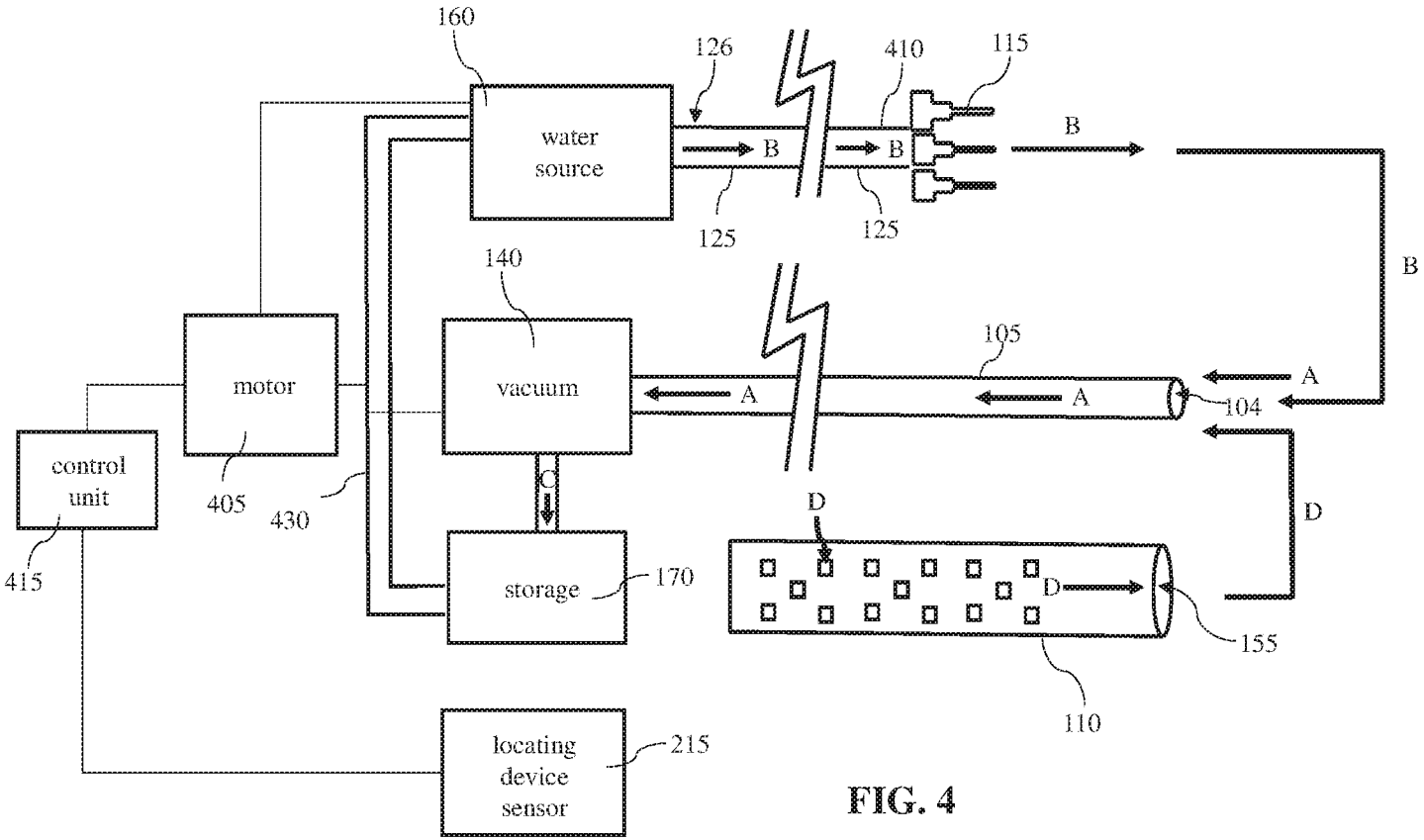
FIG. 4 is a block diagram illustrating main electrical components of the device and the flow of fluid air, fluid and material within tubular bodies of the device, according to an example embodiment; and, FIG. 5 is a block diagram of a computing device, according to an example embodiment.

Referring now to the Figures, FIGS. 1 and 2 will be discussed together. FIG. 1 is a perspective view of the device 100 coupled to a working end 103 of a hydrovac boom hose 105. In FIG. 2, the device is also coupled to a working end of a boom hose and further illustrates the flow of fluid, air and materials within the device. The hydrovac boom hose is an elongated tubular like structure. The second end or vacuum end 210 of the hydrovac boom hose is communicatively coupled to a vacuuming device 140 (as illustrated in FIG. 4). The device 100 may comprise a motor (405 as illustrated in FIG. 4) that is configured to provide suction force in direction of line A. The device 100 may also direct the earthly material and water removed to a reservoir 170 that may be configured to receive and removably store earthly material and water (as illustrated in FIG. 4).

A suction tube at the center of the device 100 is configured for removably coupling to the working end of the hydrovac boom hose, such that the opening 104 of the hydrovac boom hose remains unobstructed. Similar to the hydrovac boom hose, the suction tube may be collapsible, accordion like, telescoping, etc., and may be extendable, lengthened, shortened, raised, or lowered. Similar to the hydrovac boom hose, the suction tube may be fabricated from any number of flexible and/or resilient materials such as plastic, polymer, neoprene, or rubber. Additionally, the suction tube may also be fabricated from a metal or other rigid or partially rigid material constructed to flex or bend. The suction tube may be configured to span only a small portion of the hose, or the entire or substantial amount of the vacuum hose.

The outer housing 110 comprises a cylindrical shaped structure that surrounds and protects the device components. The outer housing is tapered at the top to allow it to be connected to the suction tube. The outer housing may comprise a plurality of slots covered by louvers 150 along the body of the outer housing to allow ambient air to travel down through between the outer housing and the suction tube to the face of the device and then back up through the suction tube. The plurality of air vents allows for air to move through the annular space 155 between the outer housing and the hydrovac boom hose. In operation, as earthly material is suctioned into the working end of the hydrovac boom hose, ambient air flows into the slots from outside the outer housing towards the working end of the hose and into the working end of the hydrovac boom hose. It should be appreciated that the slots may define any shape and can thereby be formed in a square, rectangular, circular, oval or any other shape, and such variations are within the spirit and scope of the claimed invention. Additionally, the dimensions and number of slots may vary depending on the amount of air required to travel into the working end of the hose.

A conduit 125 is coupled with the outer housing. The conduit is a pipe that supplies water to a plurality of high pressure rotating turbo nozzles 115 and is configured for emitting a stream of pressurized water through the ends 120 of the rotating turbo nozzles. The conduit may be connectively attached/removed from the hydrovacs high pressure water pump system. The conduit may comprise flexible materials such PVC, acrylic, butyrate, neoprene, polycarbonate, Polyurethane, Nylon, PVC (Vinyl) and Polyethylene, copolymers, fiber-reinforced polymers, or any combination thereof. Additionally, other materials having flexible properties can be used and are within the spirit and scope of the present invention. The conduit may be easily removeable and may be easily replaceable.

The high pressure rotating turbo nozzles are configured to provide a pressurized stream of water to a designated area. In operation, the stream of water emitted from the high pressure rotating turbo nozzles are able to erode earthly materials so that the materials may be suctioned through the opening 104 of the working end of the suction tube, which is held in place in the center of the annular space 155 between the outer housing and the hydrovac boom hose via a holder 203 attached via fasteners 205 and 207 to the end 209 of housing 110. The nozzles surround the outside of the suction tube and are connected to the conduit, which may be removeable. A first end 125 of the conduit may be attached to a water source 160 for delivering water to the high pressure rotating turbo nozzles (as illustrated in FIG. 4). A water pump may be used (as illustrated as 405 in FIG. 4) for pressurizing and/or pumping the water to the nozzles and controlled by a control unit comprising a processor (as illustrated as 415 in FIG. 4). The nozzles emit a pressurized water stream at a 15-degree angle while spinning to create a full cone spray pattern to allow the water to make contact with the entire surface area beneath the device. The nozzles may also be configured to emit water at a plurality of pressures and emitting rates (including varying intervals of pressure). The nozzles may be configured emit water between 0 pounds per square inch (PSI) and 3000 PSI and between 0 gallons per minute (GPM) and 80 GPM. Additionally, the nozzles have an adjustable element or an element that allows a user to adjust the pressure of the water stream emitted from the nozzle tip and the area of the ground contacted by the stream of water. The nozzle adjustability allows the operator to increase or decrease the area that the water emitted from the nozzles contacts.

The device may also include an onboard locating sensor device 215 that is mounted on the outer housing and positioned between the suction tube and the high pressure rotating nozzles. The onboard locating sensor device is made up of a transmitter, receiver and audible warning alarm. The onboard locating sensor device emits a magnetic frequency into the ground which then bounces back to the receiver, for monitoring, locating, or detecting utilities, conduits, or buried assets within the ground, and for providing an alarm for such upcoming utilities, conduits, and buried assets. As the device approaches closer to the utilities, conduits, and buried assets, the alarm volume increases. The sensor is adapted for communicating to a processor of the device (within a control unit) that is configured to provide an alarm to notify the operator of any underground utility or cable. Such sensors are well known to those skilled in the art and may include a resistivity sensor, a permittivity sensor, a conductivity sensor, and a magnetometer. Additionally, other sensor and circuitry may be used and are within the scope of the present invention. The alarm may be a visual or a sound alarm, however other types of alarms are within the spirit and scope of the present invention. The processer may integral with or conductively coupled or wirelessly coupled with a control unit of the device 415 (further illustrated in FIG. 5 and explained below).

The outer housing covers the high pressure rotating turbo nozzles. The outer sleeve 305 is attached to the outside edge of the outer housing to create a non-destructive/non-conductive bumper on the working end of the device. The outer sleeve is also used to set a distance between the working end of the device and high pressure rotating nozzles to protect any pipelines, fiber-optics, or utilities from being damaged by the high-pressure water stream emitted from the rotating turbo nozzles. The outer sleeve is made of non-conductive material to help eliminate electric shock and electrocution. The outer sleeve is an elongated tubular shaped body that is fabricated from any number of flexible and/or resilient materials such as a plastic or polymer, neoprene, or a rubber. Additionally, the outer sleeve may also be fabricated from a metal or other rigid or partially rigid material constructed to flex or bend.

Figure 3:
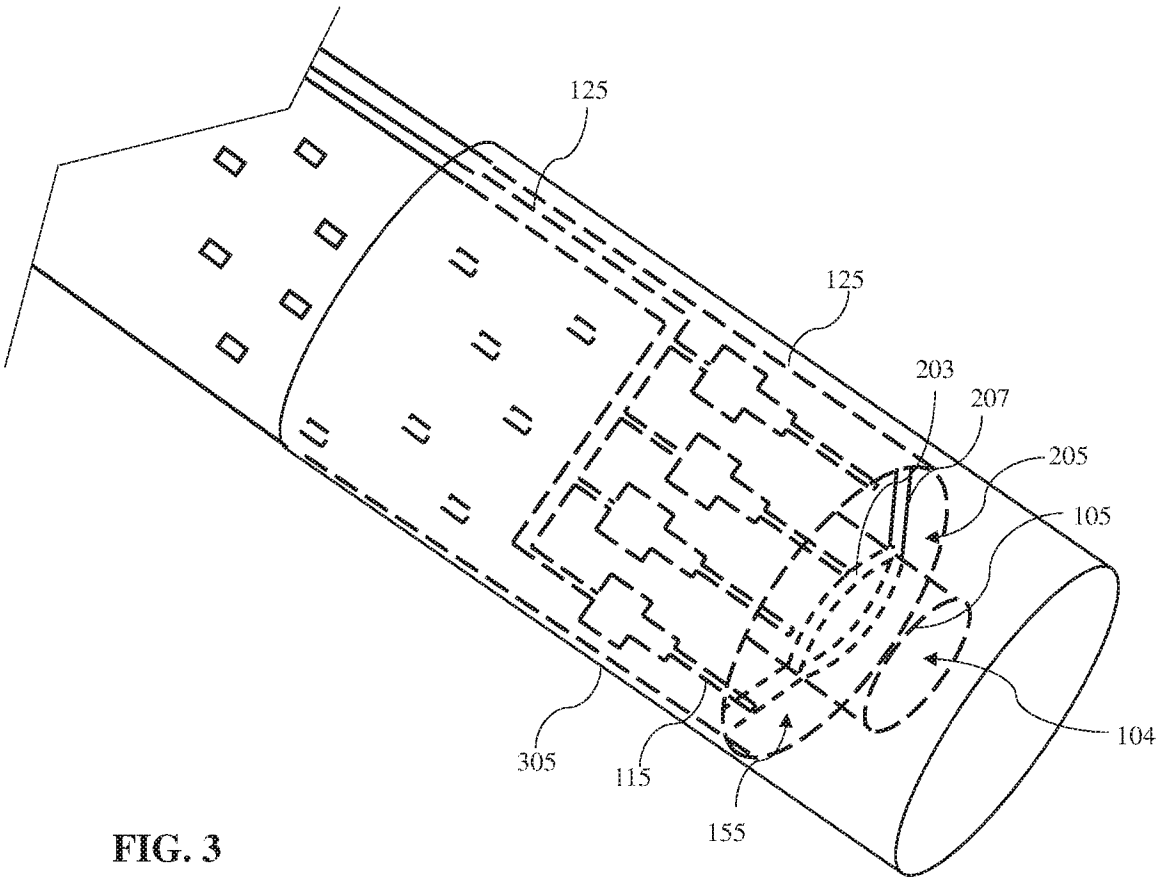
FIG. 3 is a device for coupling to a working end of a boom hose, wherein the device further includes an outer sleeve, and wherein the components within the sleeve are illustrated with broken lines, according to an example embodiment.

Referring to FIGS. 2, 3 and 4, in operation, an operator that intends to excavate a hole may attach a tubular suction tube to the device. The first end of the conduit is attached to the water source 160 so that water can communicate and flow to the nozzle end 410 of the conduit. The second end or vacuum end 210 of the vacuum boom hose is attached. Next, the operator will position the working end of the device proximate to the area to be excavated. Thereafter, the operator will activate the motor of the vacuum so that suction force in the direction of line A will force earthly materials, water, and air up the working end of the hose toward the vacuum and, in some embodiments, into the reservoir or storage bin 170. Simultaneously, pressurized water from the water source in the direction of line B is moved towards high pressure rotating turbo nozzles 115 and is emitted from the tips 120 of the high pressure rotating turbo nozzles. The pressurized water from the rotating turbo nozzles may erode the earthly material so that that water and earthly materials can be suctioned into the opening 104 of the hose. Ambient air can enter into annular space between the suction tube and the outer housing (in direction of line D) through the slots 150 along the housing. The air moves towards the working end of the suction tube because of the suction force of the hydrovac boom hose when the device is in operation.

In order to excavate, an operator will position the device coupled to the working end of the boom hose in close proximity to the area that needs to be excavated. Next the operator will activate the vacuum 140 and the water supply from the water source. As earthly material, water, and air is pulled into the working end of the hydrovac boom hose, the slots in the outer housing allow for ambient air to travel from outside the outer housing and towards the working end of the hydrovac boom hose. The stream of water emitted from the rotating turbo nozzles are able to erode earthly materials so that the materials may be suctioned through the opening of the working end of the hydrovac boom hose.

In operation, when the device is being used, the nozzles are covered by the outer sleeve, as it protrudes past the outer housing to act as a bumper guard between the device and the oncoming utilities. In other embodiments, additional attaching elements or means may be used throughout the body of the hose.

FIG. 4 is a block diagram illustrating the main electrical components of the device and the flow of fluid and air within tubular bodies of the device. The components of the device are not located as they would be on the device for illustration purposes. As explained briefly above, the control unit 415 may include a processor that is conductively coupled to the motor, water source controller, and onboard locating sensor device. Line A represents the flow of earthly material, water, and air pulled into the working end of the hydrovac boom hose by the vacuum 140. Such material may be moved in the direction of Line C and stored in a reservoir or storage bin area 170. Water is moved in the direction of Line B from the water source 160 and emitted from the openings on the ends of the high pressure rotating turbo nozzles, and then extracted by the working end of the hydrovac boom hose. Ambient air flows into the slots 150 from outside the outer housing towards the working end of the hose (in the direction of Line D) and into the working end of the hydrovac boom hose. Filters may also be used at different parts of the device to filter the air, water, etc. Additionally, filters may be used to filter the earthly material so that water may be returned to the water supply via a return conduit 430.

Figure 5:
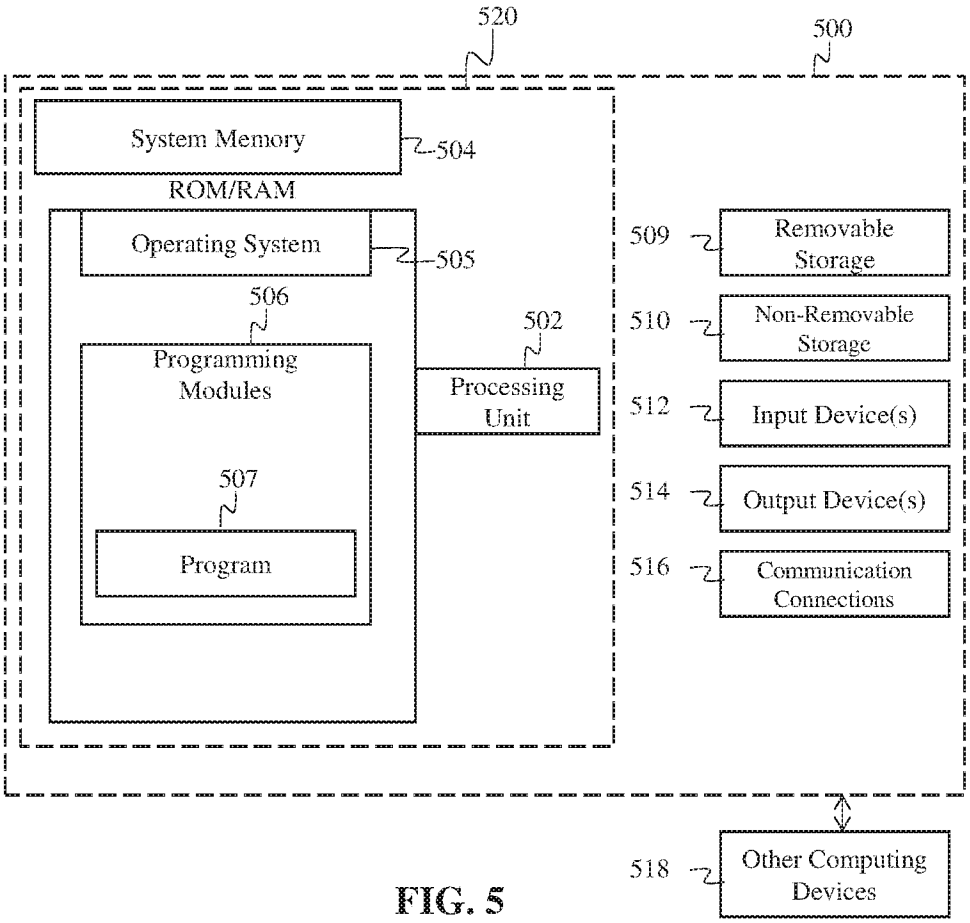

With reference to FIG. 5, a system consistent with an embodiment of the invention may include a plurality of computing devices or processors, such as computing device 500. In a basic configuration, computing device 500 may include at least one processing unit 502 and a system memory 504. Depending on the configuration and type of computing device, system memory 504 may comprise, but is not limited to, volatile (e.g. random access memory (RAM)), non-volatile (e.g. read-only memory (ROM)), flash memory, or any combination or memory. System memory 504 may include operating system 505, and one or more programming modules 506. Operating system 505, for example, may be suitable for controlling computing device 500's operation. In one embodiment, programming modules 506 may include, for example, a program module 507 for executing the actions of motor 405, control unit 415, sensor 215 for example. Furthermore, embodiments of the invention may be practiced in conjunction with a graphics library, other operating systems, or any other application program and is not limited to any particular application or system. This basic configuration is illustrated in FIG. 5 by those components within a dashed line 520.

Computing device 500 may have additional features or functionality. For example, computing device 500 may also include additional data storage devices (removable and/or non-removable) such as, for example, magnetic disks, optical disks, or tape. Such additional storage is illustrated in FIG. 5 by a removable storage 509 and a non-removable storage 510. Computer storage media may include volatile and nonvolatile, removable and non-removable media implemented in any method or technology for storage of information, such as computer readable instructions, data structures, program modules, or other data. System memory 504, removable storage 509, and non-removable storage 510 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 500. Any such computer storage media may be part of device 500. Computing device 500 may also have input device(s) 512 such as a keyboard, a mouse, a pen, a sound input device, a camera, a touch input device, etc. Output device(s) 514 such as a display, speakers, a printer, etc. may also be included. The aforementioned devices are only examples, and other devices may be added or substituted.

Computing device 500 may also contain a communication connection 516 that may allow device 500 to communicate with other computing devices 518, such as over a network in a distributed computing environment, for example, an intranet or the internet. Communication connection 516 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 504, including operating system 505. While executing on processing unit 502, programming modules 506 (e.g. program module 507) may perform processes including, for example, one or more of the stages of the process performed by control unit 415, for example, as described above. The aforementioned processes are examples, and processing unit 502 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A device for coupling to a working end of a hydrovac boom hose, comprising:

a tubular suction tube configured for removably coupling to the working end of the hydrovac boom hose, such that an opening of the working end remains unobstructed;

a plurality of high pressure turbo nozzles located around a circumference of the tubular suction tube wherein each nozzle of the plurality of high pressure nozzles spins about a unique axis, such that the high pressure turbo nozzles dislodge earthly material beneath the device, wherein the high pressure turbo nozzles are configured for emitting high pressure water that dislodge earthly material;

a plurality of air vents in an outer housing; and a conduit coupled with the outer housing, the conduit for allowing ingress of water to the plurality of high pressure turbo nozzles.

2. The device of claim 1, wherein the device further includes an outer sleeve coupled to the outer housing, wherein the outer sleeve is configured to confine fluid exiting the turbo nozzles and suction force of the hydrovac boom hose to a defined area for dislodging earthly material and protect both the device end and oncoming utilities, wherein the sleeve also is made of an non-conductive material reducing shock potential if the device were to come in contact with a live power source.

3. The device of claim 1, wherein the outer housing further comprises an onboard locating device configured for locating buried assets within the ground and for providing an alarm for such upcoming buried assets.

4. The device of claim 1, wherein the turbo nozzles have an adjustable opening so that the pressure of a stream of water emitted by the nozzles can be increased and decreased.

5. The device of claim 1, wherein the nozzles can be configured to emit water at a plurality of emitting rates.

6. The device of claim 1, wherein the nozzles emit water at a 15-degree angle while spinning to create a full cone spray pattern.

7. The device of claim 1, wherein the nozzles are configured to emit water between 0 pounds per square inch (PSI) and 3000 PSI and between 0 gallons per minute (GPM) and 80 GPM.

8. The device of claim 1, wherein the hydrovac boom hose is communicatively coupled to a vacuuming device configured for providing suction to the hydrovac boom hose.

9. A device for coupling to a working end of a hydrovac boom hose, comprising:

a hydrovac boom hose communicatively coupled to a vacuuming device configured for providing suction to the hydrovac boom hose;

a tubular suction tube configured for removably coupling to the working end of the hydrovac boom hose, such that an opening of the working end remains unobstructed, wherein an outer housing further comprises an onboard locating device configured for locating buried assets within the ground and for providing an alarm for such upcoming buried assets;

the outer housing attached to the tubular suction tube with holes in it to allow ambient air to pass through the housing;

a plurality of high pressure turbo nozzles located around a circumference of the tubular suction tube wherein each nozzle of the plurality of high pressure nozzles spins about a unique axis; and, wherein the high pressure turbo nozzles are configured for emitting high pressure water that dislodge earthly material, and wherein the turbo nozzles have an adjustable opening so that the pressure of a stream of water emitted by the nozzles can be increased and decreased;

a plurality of air vents in the outer housing; and a conduit coupled with the outer housing, the conduit for allowing ingress of water to the plurality of high pressure turbo nozzles.

10. The device of claim 9, wherein the nozzles can be configured to emit water at a plurality of emitting rates.

11. The device of claim 9, wherein the nozzles are configured to emit water between 0 pounds per square inch (PSI) and 3000 PSI and between 0 gallons per minute (GPM) and 80 GPM.

12. A device for coupling to a working end of a hydrovac boom hose, comprising:

a tubular suction tube configured for removably coupling to the working end of the hydrovac boom hose, such that an opening of the working end remains unobstructed;

a plurality of high pressure turbo nozzles located around a circumference of the tubular suction tube wherein each nozzle of the plurality of high pressure nozzles spins about a unique axis, such that the high pressure turbo nozzles surround the working end of the tubular suction tube, wherein the high pressure turbo nozzles are configured for emitting high pressure water that dislodge earthly material;

at least one air vent in the tubular suction tube; and a conduit coupled with the tubular suction tube, the conduit for allowing ingress of fluid to the plurality of high pressure turbo nozzles.

13. The device of claim 12, wherein an outer sleeve is configured to confine fluid exiting each turbo nozzle and suction force of the hydrovac boom hose to a defined area for dislodging earthly material.

14. The device of claim 12, wherein the tubular suction tube further comprises an onboard locating device configured for locating utilities and conduits within the ground and for providing an alarm for such upcoming utilities and conduits.

* * * * *